United States Patent [19]

Tasaki

[11] Patent Number: 4,819,835

[45] Date of Patent: Apr. 11, 1989

[54] TRIGGER TYPE LIQUID DISPENSER

[75] Inventor: Takaharu Tasaki, Tokyo, Japan

[73] Assignee: Yoshino Kogyosho Co., Ltd., Tokyo, Japan

[21] Appl. No.: 74,727

[22] Filed: Jul. 17, 1987

[30] Foreign Application Priority Data

| | | | |
|---|---|---|---|
| Jul. 21, 1986 | [JP] | Japan | 61-111764 |
| Dec. 27, 1986 | [JP] | Japan | 61-203540 |
| Jul. 8, 1987 | [JP] | Japan | 62-105112 |
| Jul. 8, 1987 | [JP] | Japan | 62-105113 |

[51] Int. Cl.[4] ..... B67D 5/40

[52] U.S. Cl. ..... 222/383; 222/409; 222/567; 239/333

[58] Field of Search ..... 222/321, 324, 383, 567, 222/472, 409, 631, 340, 381, 384, 372; 239/333; 92/107, 108, 130 C

[56] References Cited

U.S. PATENT DOCUMENTS

| | | | |
|---|---|---|---|
| 3,249,259 | 5/1966 | Corsette | 222/321 X |
| 4,220,285 | 9/1980 | Gualdi | 239/333 X |
| 4,357,798 | 11/1982 | Hung | 92/108 X |
| 4,424,012 | 1/1984 | Westmoreland | 92/107 X |
| 4,489,861 | 12/1984 | Saito et al. | 222/383 X |
| 4,527,741 | 7/1985 | Garneau | 222/383 X |
| 4,596,344 | 6/1986 | Corsette | 239/333 X |
| 4,618,077 | 10/1986 | Corsette | 239/333 X |
| 4,669,664 | 6/1987 | Garneau | 222/383 X |

*Primary Examiner*—F. J. Bartuska
*Assistant Examiner*—Gregory L. Huson
*Attorney, Agent, or Firm*—Parkhurst, Oliff & Berridge

[57] ABSTRACT

A trigger type liquid dispenser having a nozzle unit including a nozzle at its front end, a pump operated by a trigger and a container mount, in which the pump is operated by the trigger and has an annular cylinder including concentric outer and inner cylindrical members of double wall shape projecting forwardly of a body, and a piston unit telescoped in the annular cylinder and having an annular piston sliding on the inner surface of the outer cylindrical member and the outer surface of the inner cylindrical member. The piston unit has skirts annularly flared at the axial edges of the sliding surfaces which coact with the surface of the inner and outer cylindrical members to form a pump chamber. A spring is contained in a spring chamber formed of a bore in the inner cylindrical member of the annular cylinder with the piston unit telescoped about the inner cylindrical member, the spring urging the piston unit outwardly of the annular cylinder. The spring chamber capable of communicating with the atmosphere, and an intake valve is provided for communicating atmospheric air with the neck of the container whenever the piston unit is operated by the trigger. Thus, the trigger type liquid dispenser can protect a spring, complete a pumping action and smoothly execute the intaking operation of a liquid container.

4 Claims, 9 Drawing Sheets

TRIGGER TYPE LIQUID DISPENSER

BACKGROUND OF THE INVENTION

The present invention relates to a trigger type liquid dispenser mounted on a liquid container to dispense or atomize liquid in the container.

A conventional trigger type liquid dispenser is disclosed, for example, in Japanese Patent Publication No. 41726/1979 and Japanese Utility Model Publication No. 920/1986.

These publications disclose a dispenser body detachably engaged with the neck of a liquid container, a pump manually driven by a trigger to intake the liquid in the container in the body, and a nozzle unit for exhausting the pressurized liquid to exhaust the liquid of the container by manually operating the trigger.

The liquid dispenser disclosed in Japanese Patent Publication No. 41726/1979 further employs a pump chamber also used as a spring chamber, and a spring mounted in the pump chamber so that the spring is always dipped directly in the exhausting liquid. Thus, the spring is readily rusted or dissolved in the liquid, and such a dispenser is restricted in its utility.

The liquid dispenser disclosed in Japanese Utility Model Publication No. 920/1986 employs double walled inner and outer cylindrical members, and uses the inner cylindrical member as a pump chamber where a spring mounted in the pump chamber is always dipped in the discharging liquid. This dispenser also has similar drawbacks associated with the above dispenser.

There is also disclosed in Japanese Utility Model Publication No. 29901/1982 a liquid dispenser having a structure where a stopper projects on the side of a nozzle mounted in contact at a fork portion of a trigger. Such an arrangement prevents the trigger from overturning inwardly from the top of the side wall without limiting the structures of the engaging grooves and lugs.

In this dispenser, the trigger is readily removed from the body before the step of assembling the nozzle in case of temporarily assembling the trigger on the body when associating the dispenser to improve the assembling productivity.

The above-said Japanese Utility Model Publication No. 920/1986 discloses an atomizing head (exhaust element) of a trigger unit to be attached on the end of an injecting cylinder (exhausting cylinder).

When assembling a non-conventional dispenser where the trigger is separated from the atomizing head, it is difficult to smoothly position the exhaust element accurately at the assembling position of the body when the exhaust element is not engaged with the end of the exhaust cylinder but covered thereon. Thus, assembly productively is hardly improved.

Further, the conventional trigger type liquid dispenser is constructed as disclosed in Japanese Utility Model Publication No. 920/1981 where the inner cylindrical member is merely inserted into the outer cylindrical member.

In the conventional trigger type liquid dispenser where the inner cylindrical member is merely inserted into the outer cylindrical member, liquid may leak from the engaging surface between the outer cylindrical member and the inner cylindrical member when exhausting liquid by the operation of the trigger, thus reducing the exhausting efficiency. Therefore, a trigger type liquid dispenser which can reduce leakage of liquid from the engaging surface between the outer cylindrical member and the inner cylindrical member is desired.

SUMMARY OF THE INVENTION

It is, therefore, one primary object of the present invention to provide a trigger type liquid dispenser which can eliminate the above-mentioned troubles, drawbacks and disadvantages of the conventional liquid dispenser while protecting the spring, and which can complete a pumping action and smoothly execute the intaking operation of a liquid container.

Another object of the present invention is to provide a trigger type liquid dispenser which can eliminate the removal of a trigger from a body irrespective of the rotating position of the trigger.

Yet another object of the present invention is to provide a trigger type liquid dispenser in which an exhaust cylindrical member can be assembled with an engaging cylindrical portion readily and rapidly when assembling an exhaust element with a body.

Still another object of the invention is to provide a trigger type liquid dispenser which increases the exhausting efficiency by reducing leakage of liquid from the liquid dispenser.

In order to achieve the above and other objects, there is provided according to one aspect of the present invention a trigger type liquid dispenser having a nozzle unit including a nozzle at its front end, a pump operated by a trigger and a container mount, comprising said pump operated by the trigger having an annular cylinder including concentric outer and inner cylindrical members of double wall shape projecting forwardly of a body, and a piston unit telescoped in the annular cylinder and having an annular piston sliding on the inner surface of the outer cylindrical member and the outer surface of the inner cylindrical member, said piston unit having skirts annularly flared at the axial edges of the sliding surfaces which coact with the surface of the inner and outer cylindrical members to form a pump chamber, a spring contained in a spring chamber formed of a bore in the inner cylindrical member of the annular cylinder and the piston unit telescoped about the inner cylindrical member, said spring for urging the piston unit outwardly from the axial center, said spring chamber capable of communicating with the atmosphere, and an intake valve for communicating atmospheric air with the neck of the container whenever the piston unit is operated by the trigger.

With the above-mentioned construction of the trigger type liquid dispenser, the spring is not always dipped in the exhaust liquid. Since the spring is completely contained in the spring chamber, the spring itself is not damaged and does not hurt the operator, yet the pumping action of the pump can be completely executed to smoothly execute the intaking operation of the liquid container, and no liquid is leaked from the dispenser.

According to another aspect of the present invention, there is provided a trigger type liquid dispenser further comprising, in the first aspect, a pair of opposed right and left lip-shaped engaging members defining grooves formed on the inner surface of the sidewall 110 of a body, a pair of lugs each having a base and an end of larger diameter than the base, and projecting perpendicularly to a longitudinal axis of the trigger oppositely from lateral sides thereof at a fork portion of the trigger in such a manner that the ends of the lugs are inserted into the grooves to retain the trigger, and the bases of the lugs are narrower than the space defined by the outer end of the lip-shaped member such that the ends of the lugs are rotatably restricted in the grooves of the body. Thus, the trigger can be reliably mounted on the body irrespective of the mounting of the nozzle.

With the construction described above, the upper end of the sidewall of the trigger can be always restricted at the ends of the lug with the engaging grooves irrespective of the rotating position of the trigger to eliminate the removal of the trigger from the body.

According to yet another aspect of the present invention, there is provided a trigger type liquid dispenser having an exhaust cylindrical member projecting in a bore surrounded by an upper wall, a left sidewall and a right sidewall of a body and a piston unit telescoped by a trigger in the bore, which comprises, in the first aspect, a guide rail projecting to the front end of the body in parallel with the exhaust cylindrical member in the upper wall, and guide pieces projected on the outer surface of the engaging cylindrical portion in parallel with the axial direction of the engaging portion to interpose the guide rail therebetween. Thus, the exhaust element can be accurately and smoothly assembled with the body.

With the construction as described above, the engaging position of the exhaust cylindrical member with the engaging cylindrical portion can be readily defined when assembling the exhaust element with the body to rapidly execute the assembling steps thereafter.

According to still another aspect of the present invention, there is provided a trigger type liquid dispenser having an intake outer cylindrical member opened at its lower end with a body, and a hollow intake inner cylindrical member having a ball valve of an intake valve body and an exhaust valve body engaged within the intake outer cylindrical member to be able to dispense liquid by a trigger comprising an intake inner cylindrical member mounting structure having a mounting short cylindrical member flared outwardly at the lower end of the body, integrally formed with the intake outer cylindrical member, an extended cylindrical portion projecting from the lower end of the intake outer cylindrical member into the mounting short cylindrical member, the engaging cylindrical portion of the intake inner cylindrical member being inserted into the intake outer cylindrical member, an engaging annular cylindrical groove recessed on the periphery of the lower end of the engaging cylindrical portion so that the extended cylindrical portion is inserted into the engaging annular cylindrical groove and the lower end of the intake inner cylindrical member is flared to be inserted into the mounting short cylindrical member. Thus, liquid leakage can be eliminated.

With the construction described above, since a labyrinth-shaped portion is formed, liquid leaking under pressure to a gap between the intake outer cylindrical member and the engaging cylindrical portion of the intake inner cylindrical member is much reduced due to the engaging surface between the extended cylindrical portion and the engaging annular cylindrical groove in addition to the engaging surface between the intake outer cylindrical member and the engaging cylindrical portion of the intake inner cylindrical member to thereby increase the exhausting efficiency of the liquid.

These and other objects and features will become more apparent from the following description of the preferred embodiments of the present invention when read in connection with the accompanying drawings.

DESCRIPTION OF THE PREFERRED EMBODIMENTS

Figure 1:
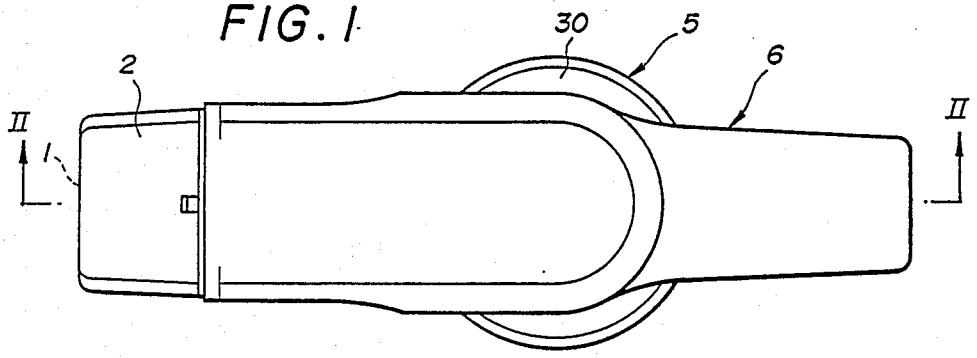
FIG. 1 is a plan view of a first embodiment of a trigger type liquid dispenser according to the present invention.
Figure 2:
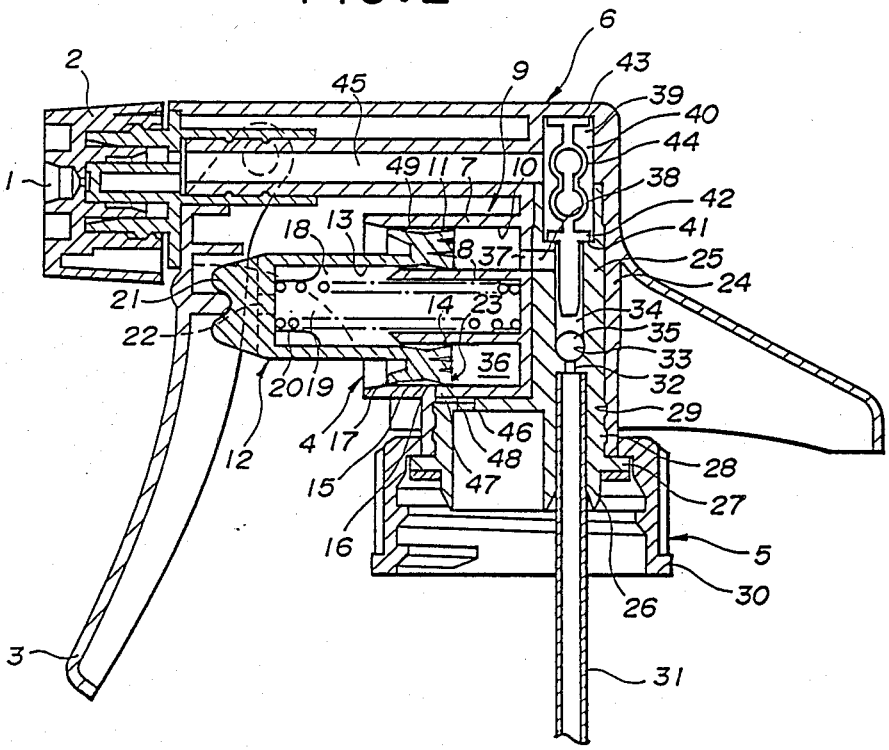
FIG. 2 is a longitudinal sectional view taken along the line II—II of FIG. 1.
Figure 3:
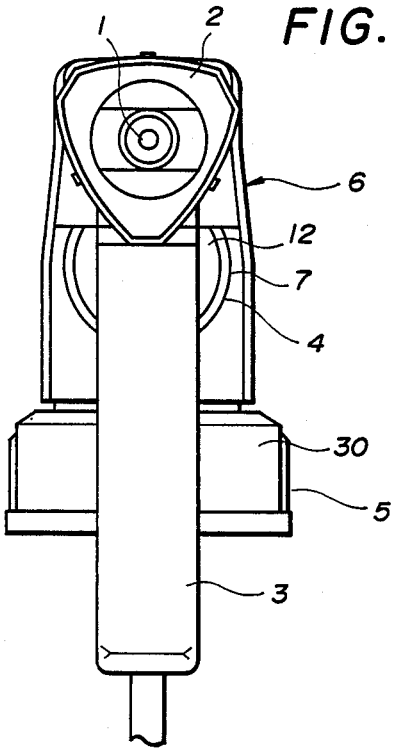
FIG. 3 is a side view of the exhaust side.
Figure 4:
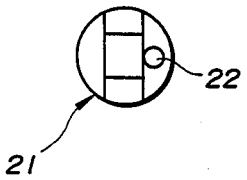
FIG. 4 is a side view of the head of the piston unit.

Embodiments of the present invention will now be described in detail with reference to the accompanying drawings. The first embodiment of a trigger type liquid dispenser according to the present invention will be described. In a first modified example of the first embodiment shown in FIGS. 1 to 4, a trigger type liquid dispenser has a nozzle unit 2 having a nozzle 1 at its front end, a pump 4 operated by a trigger 3 and a container mount 5. The pump 4 operated by the trigger 3 has an annular cylinder 9 having concentric outer and inner cylindrical members 7 and 8 of double wall shape projecting forwardly of a body 6, and a piston unit 12 telescoped in the annular cylinder 9 and having an annular piston 49 sliding on the inner surface 10 of the outer cylindrical member 7 and the outer surface 11 of the inner cylindrical member 8. The piston unit 12 has an inner skirt 14 annularly flared inwardly at the axially inner edge of the inner sliding surface 13 as the sliding surface of the piston unit 12 with the outer surface 11 of the inner cylindrical member 8, inside outer skirt 16 and outside outer skirt 17 flared outwardly at the axially inner and outer edges of the outer sliding surface 15 as the sliding surface of the piston unit 12 with the inner surface 10 of the outer cylindrical member 7 to form the annular piston 49. A spring 20 is contained in a spring chamber 19 formed of a bore 18 in the inner cylindrical member 8 of the annular cylinder 9 and the piston unit 12 telescoped in the inner cylindrical member 8 at the axial center side for urging the piston unit 12 outwardly of the axial center. The spring chamber 19 always communicates with the atmosphere through an air opening 22 perforated at the head 21 of the piston unit 12 as shown in FIGS. 2 and 4. An intake valve 23 is formed on the outside outer skirt 17 and the inside outer skirt 16 formed at outer cylindrical member 7 and the outer sliding surface 16 of the piston unit 12 to intake atmospheric air supplied to the container whenever the piston unit 12 is operated by the trigger to be described later.

An intake outer cylindrical member 24 is elevationally formed adjacent to the rear end of the annular cylinder 9 of the body 6, and an intake inner cylindrical member 25 is engaged within the intake outer cylindrical member 24. An engaging portion 26 is flared at the lower end of the intake inner cylindrical member 25, and a flange 27 is projected to contact with the neck of the container. An engaging outer ring 28 fixedly secured to the engaging portion 26 of the intake inner cylindrical member 25 and an engaging groove 29 formed at the lower edge of the body 6 to be inserted with the engaging portion 25 perform a function of preventing the intake inner cylindrical member 25 from being removed out of the body 6 by inserting the engaging inner ring 28 into the groove 29 of the body 6. A cap 30 is rotatably engaged with the flange 27 so as not to remove from the flange 27 to form the container mount 5. A dip tube 31 which can reach the bottom of the container is inserted into the lower end of the intake inner cylindrical member 25 in the cap 30. A ball valve seat 33 is formed through a valve opening 32 at the upper end of the tube 31, a cylindrical intervalve chamber 34 is formed above the ball valve seat 33, and a ball valve 35 is contained in the intervalve chamber 34. A cylinder chamber 36 formed between the outer cylindrical member 7 and the inner cylindrical member 8 of the pump 4 communicates with the intervalve chamber 34 through a cylinder opening 37 perforated at the bottom of the cylinder chamber 36 and an intake inner cylindrical member opening 38 perforated at the intake inner cylindrical member 25.

A large-diameter exhaust valve chamber 39 is integrally formed at the upper end of the intervalve chamber 34, and an exhaust valve body 40 is mounted in the valve chamber 39.

In the first modified example of the first embodiment in FIG. 2, the exhaust valve body 40 is formed at its lower end with a valve flange 42 to be contacted with an exhaust valve seat 40 formed at the lower end of the exhaust valve chamber 39, having at its upper end a connecting end 43 to be connected with the exhaust valve chamber 39, and is formed with a double ring-shaped stretchable elastic portion 44 intermediately between the connecting end 43 and the valve flange 42 for ordinarily urging the valve flange 42 in a direction which contacts with the exhaust valve seat 41.

An exhaust passage 45 is formed from the exhaust valve chamber 39 forwardly communicating with the nozzle 1 of the nozzle unit 2.

A connection opening 46 is perforated at the upper end of the engaging portion 26 of the inner cylindrical member 25, a vent hole 47 is perforated at the lowermost side of the outer cylindrical member 7, and the vent hole 47 communicates through a groove 48 with the connecting opening 46.

The vent hole 47 is so perforated at the intermediate portion, as shown in FIG. 2, that the inside outer skirt 16 and the outside outer skirt 17 are contacted with the inner surface of the outer cylindrical member where the piston unit 12 is disposed to be forwardly projected at the frontmost side, and the piston unit 12 is retreated by the trigger 3 to be disposed forwardly from the position of the outside outer skirt 17.

The nozzle unit exemplified in the drawings may employ various shapes. The nozzle unit illustrated in the drawings is for foaming or spraying.

This modified example of the first embodiment is constructed as described above, wherein the cylinder 9 of the pump 4 is formed of inner and outer cylindrical members in such a manner that the spring chamber 19 is formed in the inner cylindrical member 8 and is in constant communication with the atmosphere. Thus, the spring 20 is not dipped in the exhausted liquid at all and is not rusted or dissolved, thereby avoiding problems due to the spring 20. Further, since the cylinder chamber 36 is formed between the inner and the outer cylindrical members and the skirts 14, 16 are formed at the sliding portions of the piston unit 12 and the cylinder chamber 36, a separate seal is not necessary. Inasmuch as the inside outer skirt 16 and the outside outer skirt 17 are formed at the contacting surfaces with the piston unit 12 and the outer cylindrical member 7, and the intake valve 23 of the container is formed of the skirts 16, 17 and the inner surface 10 of the outer cylindrical member 7, atmospheric air is supplied to the container as the piston unit 12 is telescoped by the trigger 3 to prevent the pumping efficiency from decreasing due to the negative pressure in the container. Further, since the exhausted liquid might leak between the skirts 16 and 17, it is preferably intaken into the container. Thus, wasteful leakage of the exhausted liquid is entirely eliminated. Even if the liquid container is preserved for a long period of time in the state that the dispenser is attached to the liquid container, no liquid is leaked from the container. The dispenser can be readily mounted on various liquid containers to be operated simply and is thus adapted for a variety of liquid dispensers.

Figure 5:
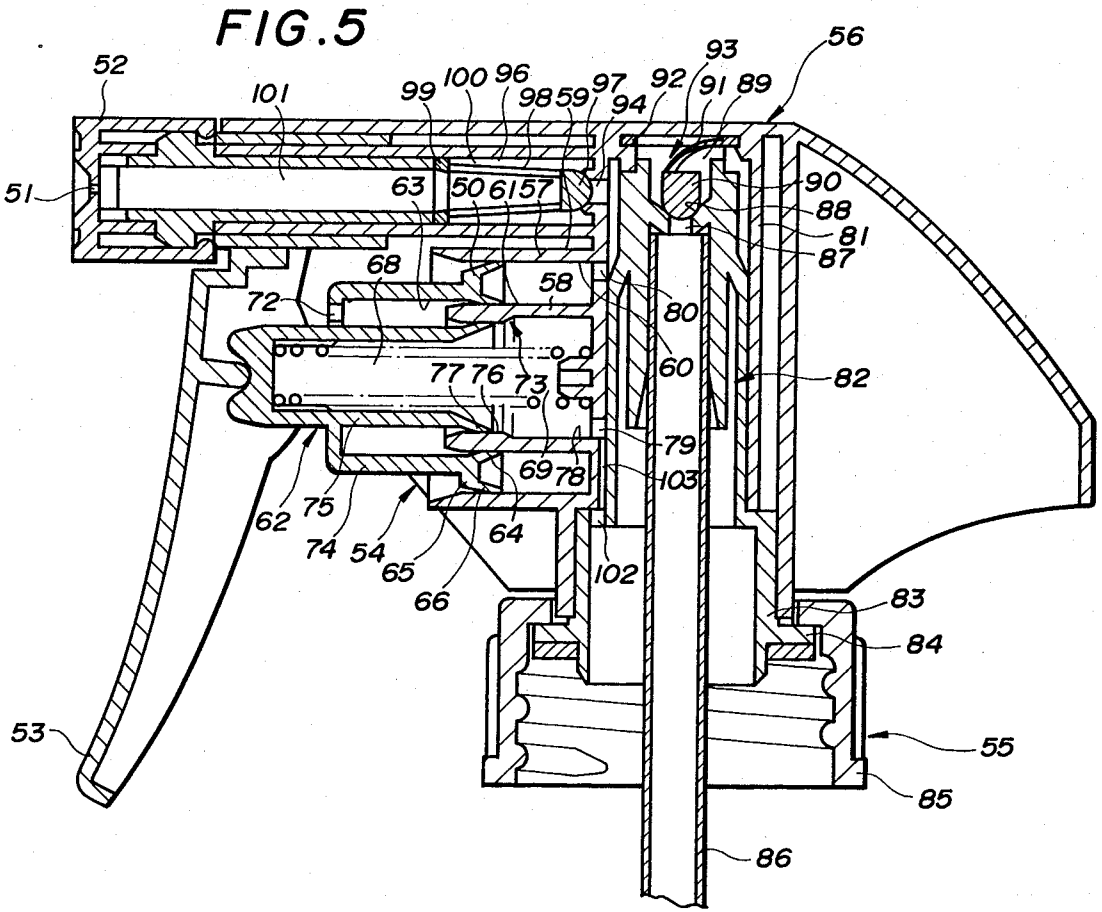
FIG. 5 is a longitudinal sectional view of a second embodiment of a trigger type liquid dispenser according to the present invention.

In a second modified example of the first embodiment of a trigger type liquid dispenser according to the present invention in FIG. 5, a trigger type liquid dispenser of this modified example has a nozzle unit 52 having a nozzle 51 at its front end, a pump 54 operated by the trigger 53 and a container mount 55. The pump 54 operated by the trigger 53 has an annular cylinder 59 having concentric outer and inner cylindrical members 57 and 58 of double wall shape projecting forwardly of a body 56, and a piston unit 62 telescoped in the annular cylinder 59 and having an annular piston 50 sliding on the inner surface 60 of the outer cylindrical member 57 and the outer surface 61 of the inner cylindrical member 58. The piston unit 62 has a head 71 contacted with the trigger 53, a piston outer cylindrical member 74 formed at its rear end with the annular piston 50 telescoped in the annular cylinder 59 formed of the outer and inner cylindrical members 57, 58, and a piston inner cylindrical member 75 telescoped in the inner cylindrical member 58 cooperatively provided with the piston outer cylindrical member 74 in a double wall shape.

The annular piston 50 has an inner skirt 64 annularly flared inwardly at the axially inner edge of the inner sliding surface 63 as the sliding surface of the piston unit 62 to be slidably contacted with the outer surface 61 of the inner cylindrical member 58, an outer skirt 66 annularly flared outwardly at the axially inner edge of the outer sliding surface 55 as the sliding surface of the piston unit 62 to be slidably contacted with the inner surface 60 of the outer cylindrical member 57, and an inner cylindrical skirt 77 annularly flared outwardly at the inner edge of the piston inner cylindrical member 75 to be slidably contacted with the small-diameter inner surface 76 of the inner cylindrical member 58 near the end of the inner cylindrical member 58.

A spring 70 is contained in a spring chamber 69 formed of a bore 68 made in the inner cylindrical member 58 of the annular cylinder 59 and the piston unit 62 telescoped in the inner cylindrical member 58 for urging the piston unit 62 outwardly of the axial center. The inner surface of the inner cylindrical member 58 forms a large-diameter inner surface 78 to the rear end continued to the small-diameter inner surface 62 near the end of the inner cylindrical member 58. A vent hole 79 is perforated at the rear end of the spring chamber 69, and an air opening 72 is perforated at the piston outer cylindrical member 74 communicating with the atmosphere.

An outer cylindrical member 81 is elevationally formed adjacent to the rear ends of the annular cylinder 59 of the body 56 and the spring chamber 69, and an inner cylindrical member 82 is engaged with the outer cylindrical member 81. An engaging portion 83 is flared at the lower end of the inner cylindrical member 82, and a flange 84 is projected to contact with the neck of the container. An engaging outer ring 28 is fixedly secured to the engaging portion 83 of the intake inner cylindrical member 82. A cap 85 is rotatably engaged with the flange 84 so as not to be removed from the flange 84 to form the container mount 55.

A dip tube 86 which can reach the bottom of the container is inserted into the inner cylindrical member 82, an intake valve seat 88 is formed through an intake valve opening 87 at the upper end of the tube 86, an intervalve chamber 89 is formed above the intake valve seat 88, and an intake valve 93 integrally formed with an intake valve sheet 92 through an elastic support 91 at an intake valve head 90 is mounted in the intervalve chamber 89. The annular cylinder 59 of the pump 54 communicates through a cylinder opening 80 perforated at the bottom of the cylinder 59 with the intervalve chamber 89.

The intervalve chamber 89 communicates through an exhaust valve opening 94 perforated at the forward side and an exhaust valve seat 92 with an exhaust valve chamber 96, and an exhaust valve 100 integrally formed through an elastic support 98 with an exhaust valve head 97 mounted in the exhaust valve chamber 96.

An exhaust passage 45 is formed from the exhaust valve chamber 97 forwardly communicating with the nozzle 51 of the nozzle unit 52.

A connecting opening 102 is perforated at the upper end of the engaging portion 83 of the inner cylindrical member 82, and the vent hole 79 communicates through a groove 103 with the connecting opening 102.

The inner cylindrical skirt 77 contacts the small diameter inner surface 76 of the inner cylindrical member 58 when the piston unit 62 is disposed forwardly at the frontmost side in FIG. 5 to shut off the spring chamber 69 from the atmosphere. When the trigger 53 is operated and the piston unit 62 is retreated, the liquid in the annular cylinder 59 is exhausted from the nozzle 51 by the operation of the annular piston 50, and the inner cylindrical skirt 77 is simultaneously moved backward. When the inner cylindrical skirt 77 arrives at the portion of the large-diameter inner surface 78 of the inner cylindrical member 58, the skirt 77 does not contact the large-diameter inner surface 78 of the inner cylindrical member 58 so that the spring chamber 69 is opened through the air opening 72 with the atmosphere. Since the spring chamber 69 communicates with the head of the container through the vent hole 79, the groove 103 and the connecting opening 102, air is introduced from the atmosphere whenever the piston unit 62 is retreated if negative pressure is generated in the container due to the exhaust of liquid from the container to thereby eliminate the negative pressure in the container. Therefore, this can eliminate the liquid exhaust preventing phenomenon due to the negative pressure in the container. In other words, the intake valve is composed of the inner cylindrical skirt 77 of the piston unit 62, the small-diameter inner surface 61 and the large-diameter inner surface 78.

In this modified example of the first embodiment, the annular cylinder 59 and the spring chamber 69 are separately disposed, and the spring 70 is not dipped in the exhausted liquid. Thus, there are no problems due to the spring 70. Since the intake valve 73 is formed, the atmospheric air is supplied to the container as the piston unit 62 is telescoped by the trigger 53 to prevent the pumping efficiency from decreasing. Even if the liquid is leaked to the spring chamber 69, it is preferably intaken into the container, thereby entirely eliminating wasteful leakage of the exhausted liquid.

The various dispensers can be readily mounted on the container to be adapted for a variety of liquid dispensers.

Figure 6:
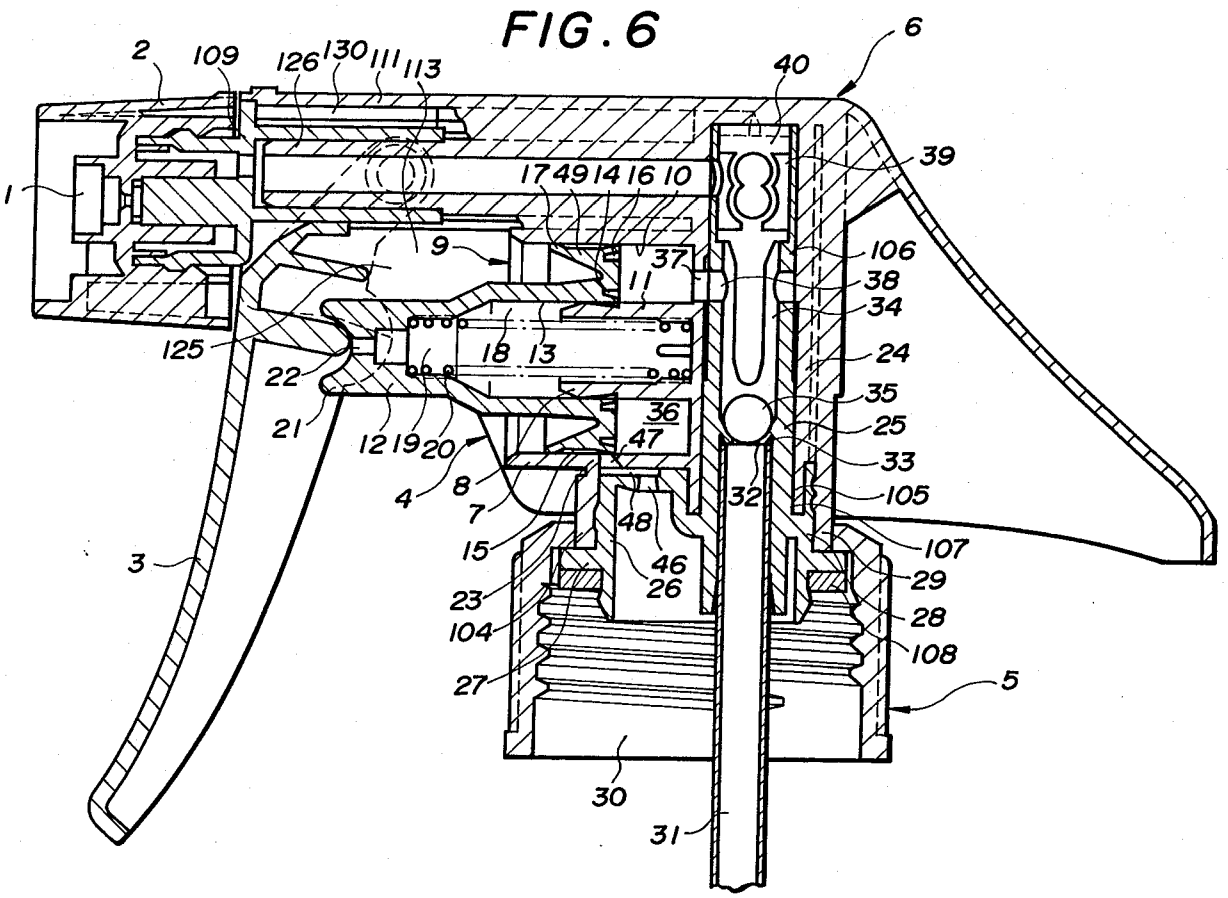
FIG. 6 is a side view of a third embodiment of a trigger type liquid dispenser according to the present invention.
Figure 7:
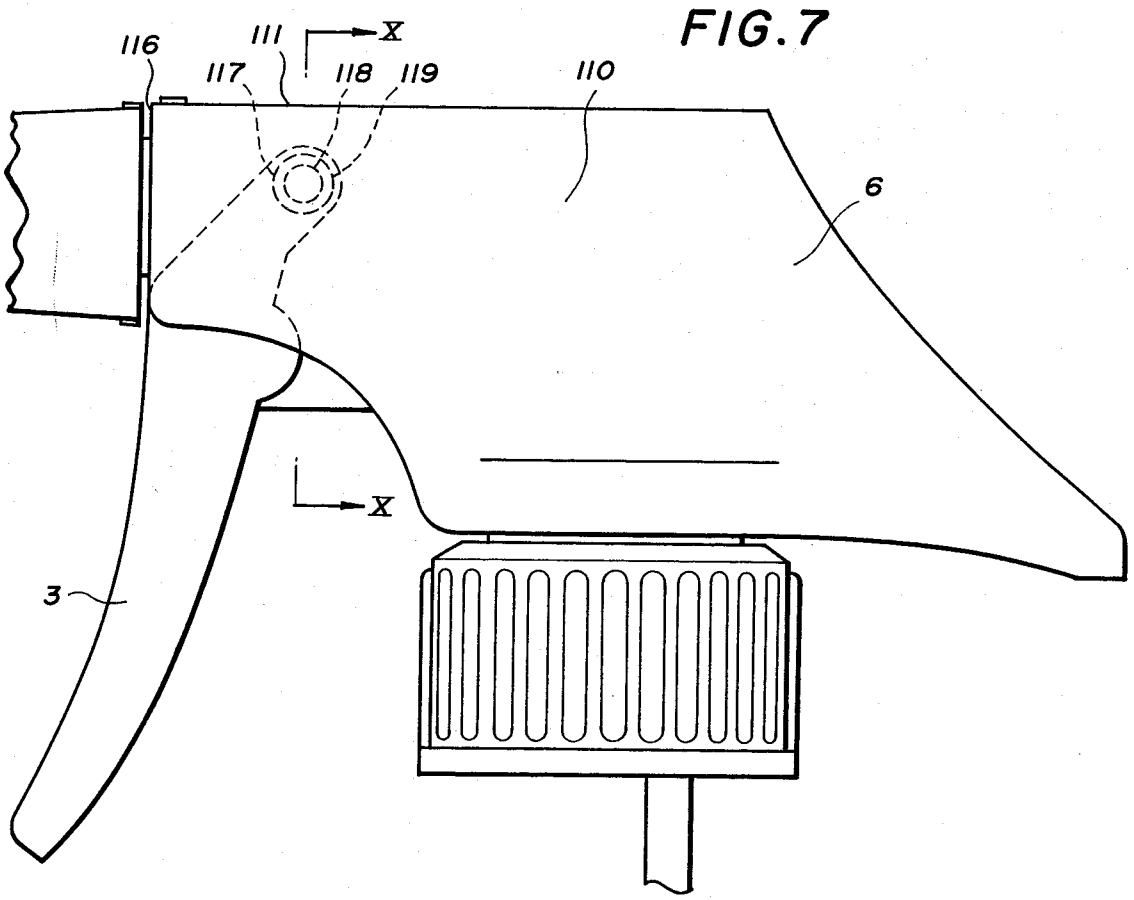
FIG. 7 is a side view of the body.

In a third modified example of the first embodiment of a trigger type liquid dispenser according to the present invention shown in FIGS. 6 and 7, the same reference numerals as those in the first modified example designating the same or corresponding parts and units, and the detailed description thereof will be omitted.

A second embodiment of a trigger type liquid dispenser according to the present invention will now be described.

Figure 12:
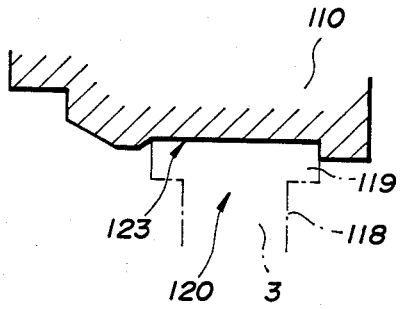
FIG. 12 is a sectional view of the portion taken along the line XII—XII in FIG. 11.
Figure 13:
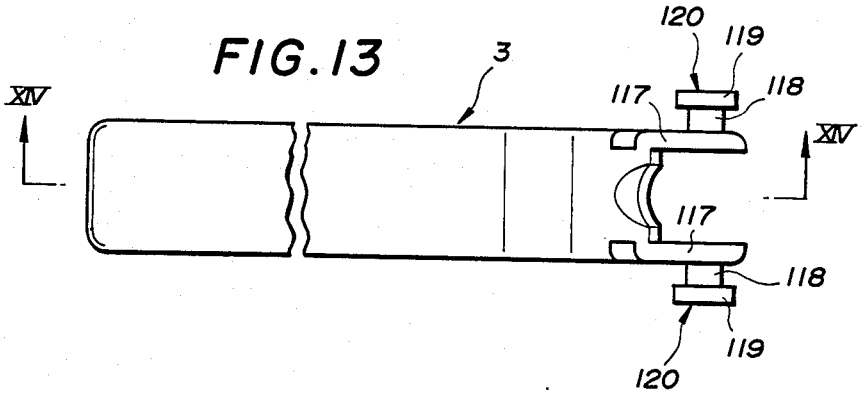
FIG. 13 is a front view of the trigger.
Figure 14:
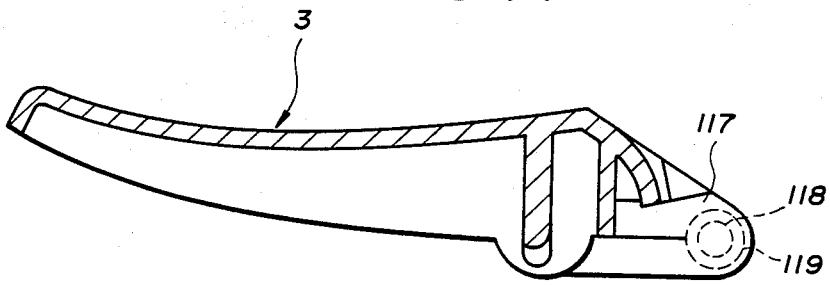
FIG. 14 is a sectional view taken along the line XIV—XIV of FIG. 13.
Figure 15:
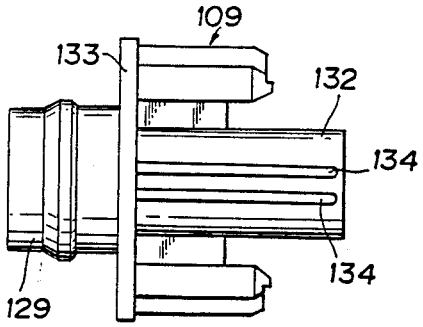
FIG. 15 is a plan view of the exhaust element.
Figure 18:
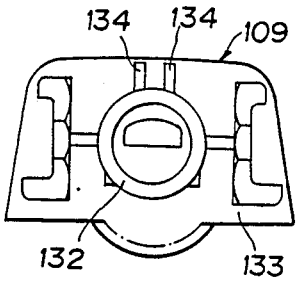
FIG. 18 is a side view of the element at an engaging cylindrical portion side.
Figure 16:
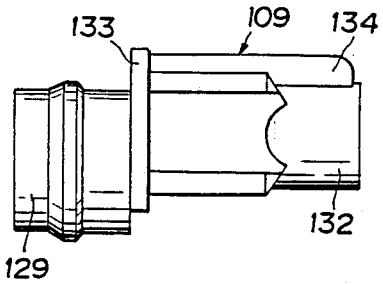
FIG. 16 is a side view of the element.
Figure 19:
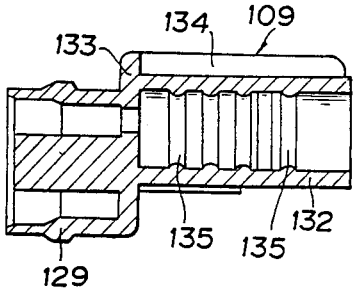
FIG. 19 is a longitudinal sectional view of the element at the axial center.
Figure 17:
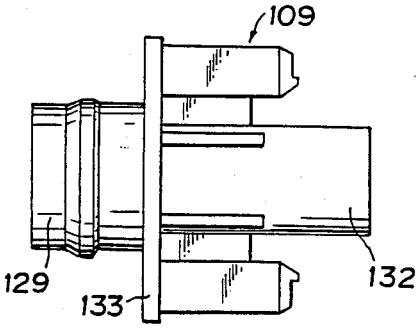
FIG. 17 is a bottom view of the element.

As shown in FIGS. 7, 8 and 10–14, a trigger type liquid dispenser of the second embodiment further comprises, in the first embodiment, a pair of opposed right and left outwardly extending lip-shaped engaging grooves 115 formed in section on the inner surface 114 of the sidewall 110 of a body 6, a pair of lugs 120 each having a base 118 and an end 119 of larger diameter than the base 118, projecting perpendicularly to a longitudinal axis of the trigger 3 oppositely from lateral sides thereof at fork portion 117 of the trigger 3 in such a manner that the ends 119 of the lugs 120 are inserted into the spaces 121 of the grooves 115, and the bases 118 of the lugs 120 disposed respectively in the spaces 122 formed at the fork portions 117 such that the bases 118 are narrower than the spaces 121 of the grooves 115 of the body 6 and the ends 119 of the lugs 120 are rotatably restricted in the grooves 115 of the body 6. Projecting strips 128 project on the inner surface of the sidewalls 110 of the body 6 at the position for holding the lugs 120 of the rotating trigger 3 at the longitudinal and lateral positions of the lugs 120 as shown in FIG. 12.

Figure 10:
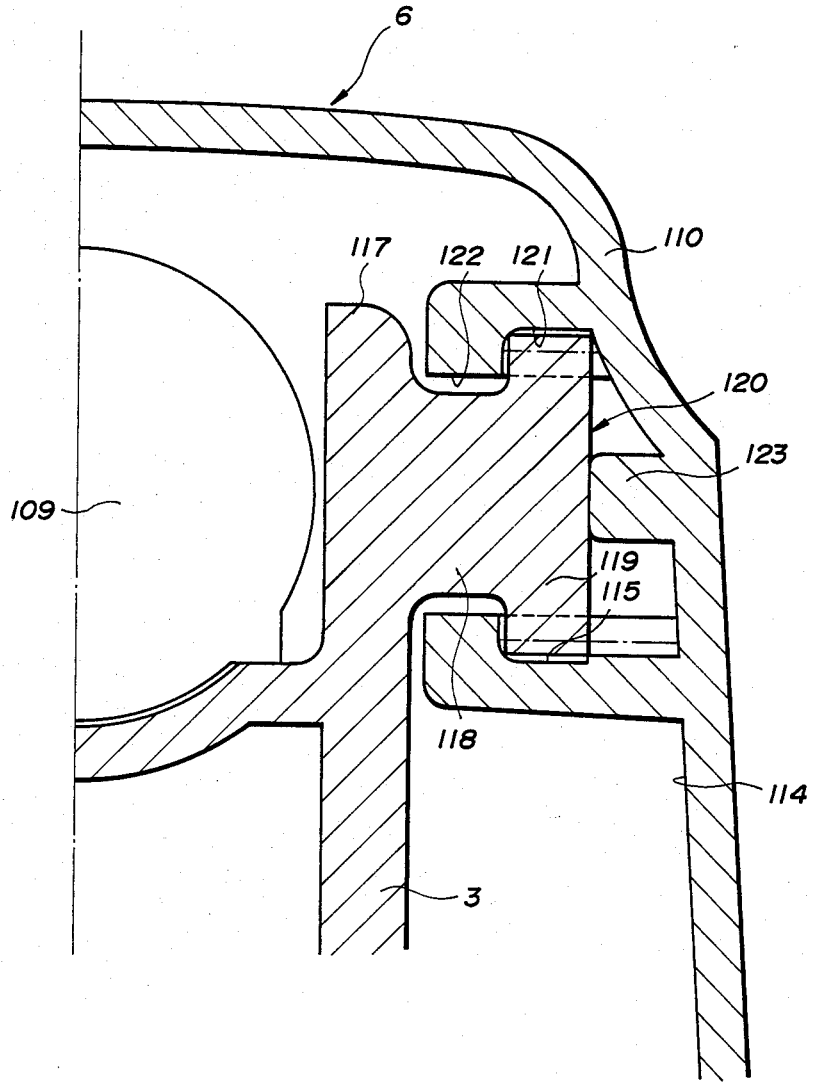
FIG. 10 is an enlarged sectional view taken along the line X—X of FIG. 7.
Figure 11:
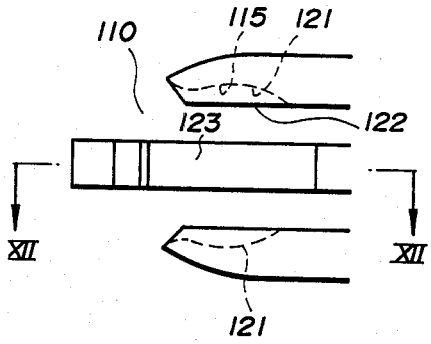
FIG. 11 is an enlarged inside view of the portion designated as seen from an arrow in FIG. 3.

As shown in FIG. 10, the fork portions 117 are contacted with exhaust elements 109 irrespective of the rotation of the trigger 3.

Since the ends of the lugs are rotatably restricted in the grooves as described above, the lugs are not necessarily contacted inwardly due to the nozzle to prevent the fork portions of the trigger from inwardly overturning irrespective of the rotation of the trigger so that the trigger can be rotatably restricted even during the temporary assembling work and after the assembling is completed.

A third embodiment of a trigger type liquid dispenser according to the present invention will now be described.

Figure 8:
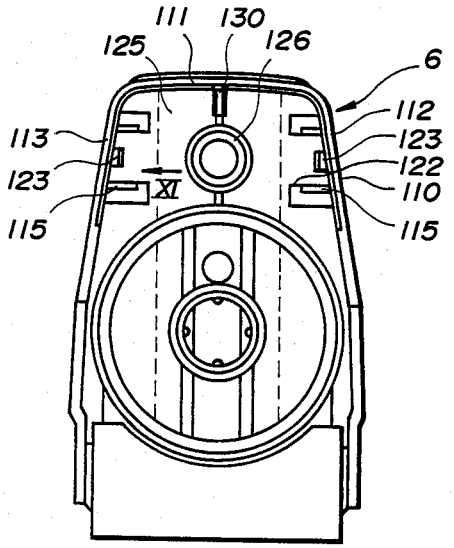
FIG. 8 is a front view of the body.
Figure 9:
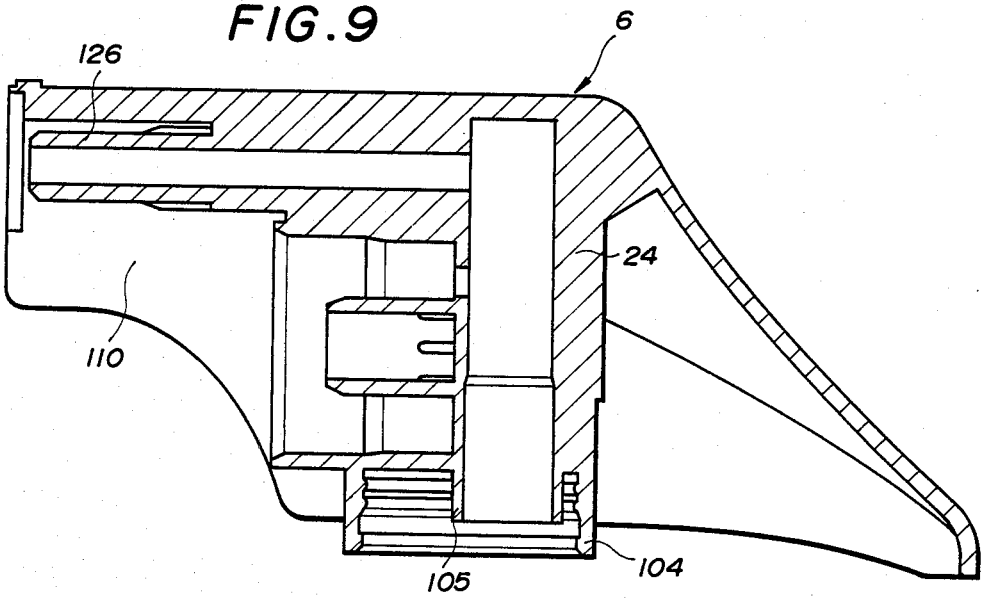
FIG. 9 is a longitudinal sectional view of the body.

A trigger type liquid dispenser of this third embodiment having, as shown in FIG. 6, an exhaust cylindrical ember 126 projecting in a bore 125 surrounded by an upper wall 111, a left sidewall 112 and a right sidewall 113 of a body 6 and a piston unit 12 telescoped by a trigger 3 in the bore 125 comprises a guide rail 130 projecting to the front end 116 of the body 6 in parallel with the exhaust cylindrical member 126 in the upper wall 111 as shown in FIGS. 6 to 8, and engaging cylindrical portions 132 of the exhaust elements 109 covered on the ends of the exhaust cylindrical member 126 as shown in FIG. 6. The exhaust elements 109 are formed in the shape as shown in FIGS. 15 to 19, having a flange 133 formed at the center, the engaging cylindrical portion 132 projecting backwardly of the flange 133, and guide pieces 134, 134 projecting from the outer surface of the engaging cylindrical portion 132 in parallel with the axial direction of the engaging portion 132 to interpose the guide rail 130 therebetween when assembling them with the body 6.

In order to completely hold the engaging cylindrical portion 132 after the exhaust cylindrical member 126 is press-fitted into the engaging cylindrical portion 132 of the exhaust element 109, projecting rings 135, 135 protrude circumferentially on the inner wall surface of the engaging portion 132. Therefore, after assembling, the exhaust element 109 may not be separated from the exhaust cylindrical portion 126 during use as a trigger type liquid dispenser, and the liquid may not be leaked. A nozzle unit engaging cylindrical member 129 is projected to mount a nozzle unit 2 from which a nozzle 1 is projected at the forward side of the flange 133.

Since the guide rail of the body side is interposed to be held between the guide pieces of the exhaust element side in case of assembling to cover the exhaust cylindrical portion with the exhaust element as described above, the assembling position of the exhaust element is reliably established, and the exhaust element can be thereafter readily and rapidly associated to cover the exhaust cylindrical portion to improve the assembling productivity.

A fourth embodiment of a trigger type liquid dispenser according to the present invention will be described.

A trigger type liquid dispenser of this fourth embodiment having an intake outer cylindrical member 24 opened at its lower end with a body 6, and a hollow intake inner cylindrical member 25 having a ball valve 35 of an intake valve body and an exhaust valve body 40 engaged within the intake outer cylindrical member 24 to dispense liquid by a trigger 3 comprises a mounting short cylindrical member 104 flared outwardly at the lower end of the body 6 integrally formed with the intake outer cylindrical member 24, an extended cylindrical portion 105 projecting from the lower end of the intake outer cylindrical member 24 into the mounting short cylindrical member 104, the engaging cylindrical portion 106 of the intake inner cylindrical member 25 being inserted into the intake outer cylindrical member 24, an engaging annular cylindrical groove 107 recessed on the periphery of the lower end of the engaging cylindrical portion 106 so that the extended cylindrical portion 105 is inserted into the engaging annular cylindrical groove 107 and the lower end of the intake inner cylindrical member 25 is flared to be inserted into the mounting short cylindrical member 104.

The body 6 is mounted through a flange 27 of the intake inner cylindrical member 25 engaged with the mounting short cylindrical member 104, a packing 108 and a cap 30 at a liquid container, and the liquid in the liquid container is exhausted from the liquid container via a nozzle 1 through a dip tube 31, a ball valve 35, an exhaust valve body 40, an exhaust element 109 and a nozzle unit 2 by the operation of the piston unit 12 telescoped by the trigger 3 and the spring 20.

Since the intake inner cylindrical member is inserted into the intake outer cylindrical member by engaging the extended cylindrical portion into the engaging annular cylindrical groove as described above in this embodiment, the possibility of liquid leaking from a gap between the intake outer cylindrical member and the intake inner cylindrical member is much reduced as compared with a conventional liquid container in which the intake inner cylindrical member is merely engaged with the intake outer cylindrical member, which results in entirely eliminating the leakage of the liquid from the liquid container and improves the liquid exhausting efficiency by the same trigger operation as the liquid dispenser.

Since the first to fourth embodiments of the trigger type liquid dispenser are constructed and operated as described above according to the present invention, the cylinder of the pump is formed of double wall cylindrical members so that the inner cylindrical member forms therein the spring chamber, atmospheric air is introduced into the spring chamber, the spring is not dipped in the exhausted liquid, and the spring is thus not rusted or dissolved in the liquid, thereby eliminating problems associated with the spring. Since the skirts are formed at the sliding portions of the annular cylinder and the piston unit in these embodiments, a separate seal is not necessarily provided to form the intake valve, so that atmospheric air is supplied to the container as the piston unit is telescoped by the trigger to prevent the pumping efficiency from decreasing due to the negative pressure in the container, thereby entirely obviating the wasteful leakage of the exhaust liquid. Even if the liquid container is preserved or allowed to stand for a long period of time while the liquid container is mounted with the dispenser, no liquid is leaked from the container so that the dispenser can be readily and rapidly mounted on or dismounted from the liquid container.

What is claimed is:

1. A trigger type liquid dispenser having a nozzle unit including a nozzle at its front end, a pump operated by a trigger and a container mount, comprising said pump operated by the trigger having an annular cylinder including concentric outer and inner cylindrical members of double wall shape projected forwardly of a body, and a piston unit telescoped in the annular cylinder and having an annular piston sliding on the inner surface of the outer cylindrical member and the outer surface of the inner cylindrical member, said piston unit having skirts annularly flared at the axial edges of the sliding surfaces which coact with the surface of the inner and outer cylindrical members to form a pump chamber, a spring contained in a spring chamber formed of a bore in the inner cylindrical member of the annular cylinder and the piston unit telescoped about the inner cylindrical member, said spring urging the piston unit outwardly of the annular cylinder, said spring chamber capable of communicating with the atmosphere through the piston unit, and an intake valve on said outer cylindrical member for communicating atmospheric air with the neck of the container upon which the assembly is mounted whenever the piston unit is operated by the trigger.

2. The liquid type liquid dispenser according to claim 1, further comprising a pair of opposed right and left outwardly extending lip-shaped engaging members defining grooves there-behind formed on an inner surface of a sidewall of the body, a pair of lugs on the trigger each having a base and an end of a larger diameter than the base and projecting perpendicularly to a longitudinal axis of the trigger oppositely from lateral sides thereof at a fork portion of the trigger in such a manner that the ends of the lugs are inserted into the grooves to retain the trigger, and the bases of the lugs are narrower than the space defined by the outer end of the lip-shaped members such that the ends of the lugs are rotatably restricted in the grooves of the body.

3. The trigger type liquid dispenser according to claim 1 further comprising an exhaust cylindrical member projecting in a bore surrounded by an upper wall, a left sidewall and a right sidewall of the body, said piston unit being telescoped by said trigger mounted in the bore on a guide rail projecting to the front end of the bore in parallel with said exhaust cylindrical member in the upper wall, and guide pieces projected on an outer surface of an engaging cylindrical exhaust portion engaging said exhaust cylindrical member in parallel with the axial direction of the engaging portion to interpose the guide rail between the guide pieces.

4. The trigger type liquid dispenser according to claim 1 further comprising an intake outer cylindrical member opened at a lower end of said intake outer cylindrical member, a hollow intake inner cylindrical member having a ball valve of an intake valve body and an exhaust valve body engaged within the intake outer cylindrical member to intake and exhaust liquid to said annular cylinder, an intake inner cylindrical member having a mounting short cylindrical member flared outwardly at the lower end thereof, integrally formed with the intake outer cylindrical member an extended cylindrical portion projected from the lower end of the intake outer cylindrical member into the mounting short cylindrial member to engage the two, the cylindrical portion of the intake inner cylindrical member being inserted into the intake outer cylindrical member, and an engaging annular cylindrical groove recessed on the periphery of the lower end of the engaging portion of the outer cylindrical member so that said short cylindrical member is inserted into the engaging annular cylindrical groove, the lower end of the intake outer cylindrical member being inserted into said mounting short cylindrical member.

* * * * *